United States Patent [19]

Mino

[11] 4,036,447

[45] July 19, 1977

[54] GROOVED TRAVERSE DRUM FOR WINDER

[75] Inventor: Masao Mino, Yao, Japan

[73] Assignee: Kabushiki Kaisha Mino Seisakusho, Osaka, Japan

[21] Appl. No.: 627,355

[22] Filed: Oct. 30, 1975

[30] Foreign Application Priority Data

Nov. 7, 1974 Japan ..... 49-135105

[51] Int. Cl.[2] ..... B65H 54/28; B65H 54/48

[52] U.S. Cl. ..... 242/43.2

[58] Field of Search ..... 242/43.2

[56] References Cited

U.S. PATENT DOCUMENTS

| | | | |
|---|---|---|---|
| 3,022,021 | 2/1962 | Zollinger | 242/43.2 |
| 3,480,217 | 11/1969 | O'Brien | 242/43.2 |
| 3,806,053 | 4/1974 | Kinariwala | 242/43.2 |

*Primary Examiner*—Stanley N. Gilreath

*Attorney, Agent, or Firm*—Hall & Houghton

[57] ABSTRACT

A grooved traverse drum for a winder wherein in order to improve the wear resistance of the turns at opposite traverse ends of the yarn guide groove formed along the cylindrical surface of the drum, a wear-resisting member is inserted in each of said turns.

3 Claims, 9 Drawing Figures

GROOVED TRAVERSE DRUM FOR WINDER

BACKGROUND OF THE INVENTION a. Field of the Invention

The present invention relates to an improved grooved traverse drum for a winder used to produce cheeses or cones.

b. Description of the Prior Art

It is known that the grooved traverse drum (herein after referred to simply as drum) is subject to wear, though slightly, along the various areas of the yarn guide groove, especially in the bottom of the turns at opposite ends of the drum where the yarn turns back as it traverses in the yarn guide groove, since said bottom is most heavily loaded owing to the frequent repetition of rubbing by the yarn, said wear forming a cause of yarn breakage and deterioration in quality.

The conventional practice adopted as a measure of prevention of the above phenomenon has been to apply surface treatment such as alumite treatment or hard chrome plating to the surface of the drum and to the inner surface of the yarn guide groove so as to increase the wear resistance.

Even with such surface treatment applied, however, it has not been possible to avoid such wear when the yarn to be wound is one which itself is highly wear-resistance, such as polyester type synthetic yarn or worsted yarn. Consequently, a surer wear-prevention means has been taken by inserting a member formed of a highly wear-resistant material, e.g., aluminum oxide or titanium oxide, into the particularly severaly wearable area rubbed by the traveling yarn at the turns at opposite traverse ends of the yarn guide groove, so that the yarn travels in contact with the surface of said member.

Examples of previously known drums are shown in FIGS. 4, 4*a*, 4*b*, 4*c*, and 4*d* of the drawing. These known constructions will now be described with reference to these named Figures. In FIG. 4, a wear-resistant member 1*a* is horizontally inserted and fixed in position so as to form the bottom of a turn 3' at either traverse end. In FIG. 4*a*, a wear-resistant member 1*a* is inserted from the surface of the drum along the lateral surface of a turn 3' at either traverse end and fixed in position so as to form a lateral surface against which the yarn will be rubbed. In FIG. 4*b*, a wear-resistant member 1*a* is obliquely inserted along the lateral surface of a turn 3' at either traverse end and fixed in position by an adhesive filler 4. In FIG. 4*c*, wear-resistant members $1a_1$ and $1a_2$ are fixed in position so as to form the inner lateral surface of a turn 3' at either traverse end and a wear-resistant member $1a_3$ is horizontally inserted and fixed in position so as to form the bottom of the turn 3' at either traverse end. In FIG. 4*d*, a werar-resistant member 1*a* is inserted from the surface of the drum along the lateral surface of a turn 3' at either traverse end and fixed in position so as to form a lateral surface and a portion of a bottom against which the yarn is rubbed.

These methods, though more effective for wear prevention than the mere application of a surface treatment procedure as described above, has the following respective disadvantages. The construction shown in FIGS. 4, 4*a*, and 4*b*, in which the yarn travels in contact with a portion of the groove bottom as it turns back at the turns at opposite traverse ends, have the disadvantage that the yarn travels as guided by an insertion boundary 5 between the member 1*a* and the turn 3', resulting in early wear of the relatively soft material suitable for the drum. The methods shown in FIGS. 4*c* and 4*d* have the danger of the member embedded in the drum tending to be thrown out under the centrifugal force during rotation, so that it has been necessary to pay careful attention to the operation thereby adding to the cost.

The method shown in FIG. 4*d* has the further disadvantages that the yarn traveling along the groove bottom causes early wear of a boundary 5 between the wear-resistant member 1*a* and the relatively soft material 8 suitable for the drum.

FIG. 5 is a partial enlarged sectional view of the drum groove shown in FIG. 4*b* and serves to better illustrate the disadvantages of the construction. The yarn 6 is wound on a yarn package 9 while being urged against the lateral surface of a wear-resistant member 1*a* and against the lateral surface of a groove formed of a relatively soft material suitable for the drum, as indicated by an arrow *b*. In this connection, since the angle of inclination $\alpha$ of the wear-resistant member 1*a* with respect to the axis is smaller than the angle of inclination $\beta$ of the lateral surface of the relatively soft material 8 suitable for the drum, an abnormal force acts instantaneously on the boundary 7 between the wear-resistant member 1*a* and the relatively soft material 8 suitable for the drum. As a result, a slight amount of wear is produced in the relatively soft material 8 suitable for a drum, forming a cause of deterioration in quality such as yarn breakage and napping.

SUMMARY OF THE INVENTION

The present invention has for its object the provision of a grooved traverse drum for a winder capable of eliminating the above-described disadvantages inherent in the prior art.

Another object is to provide an inexpensive drum.

According to the present invention, a wear-resistant member is disposed in the turn at either traverse end of a yarn guide groove in a drum in such a manner that the wear-resistant member smoothly guides the yarn passing around said turn and that the inner surface of the groove of the relatively soft material suitable for the drum will not be strongly pressed by the traveling yarn at the turn at either traverse end of said yarn guide groove and will be likewise protected even if the yarn swings laterally. More particularly, the wear-resistant member is disposed so that the yarn passing around the turn at either traverse end of the yarn guide groove is smoothly guided to a portion of the wear-resistant member without being deflected to any other location. The guide portion of the wear-resistant member with which the arn is contacted as a result of the yarn being guided in the manner described above presents an arcuate smooth guide surface so as not to interfere with the smooth travel of the yarn.

Further, according to the present invention, the wear-resistant member is designed to be easily inserted into the drum and fixed in position so as not to be thrown out under the centrifugal force exerted during the rotation of the drum.

Other details and merits will be made clear in the following description of a preferred embodiment of the invention.

BRIEF DESCRIPTION OF THE PREFERRED EMBODIMENT

Figure 1:
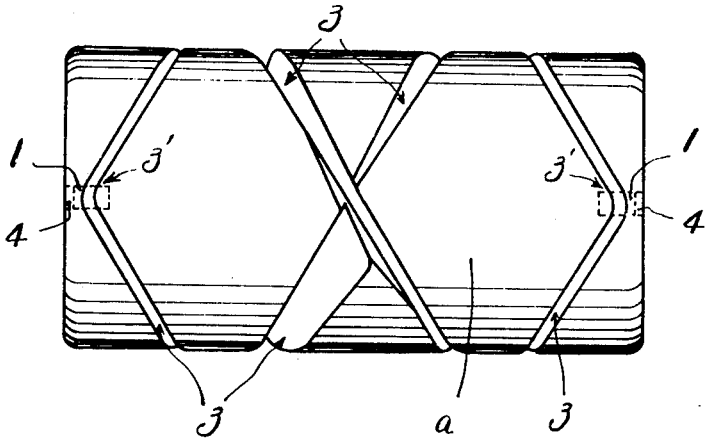
FIG. 1 is a schematic front view of a drum according to the present invention.
Figure 2:
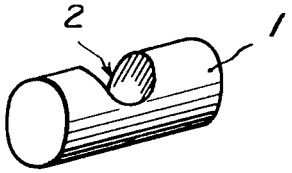
FIG. 2 is a perspective view of a wear-resistant member to be used in the invention.
Figure 3:
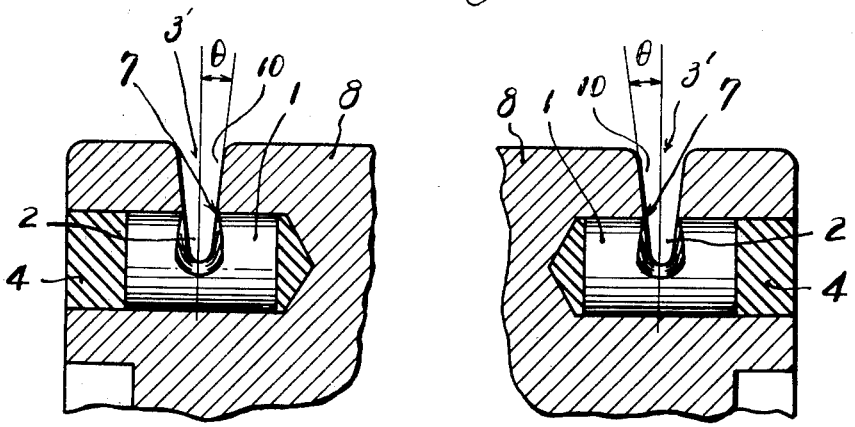
FIG. 3 is a longitudinal section of a turn in a yarn guide groove at either end of the drum having the wear-resistant member shown in FIG. 3 applied thereto.
Figure 4:
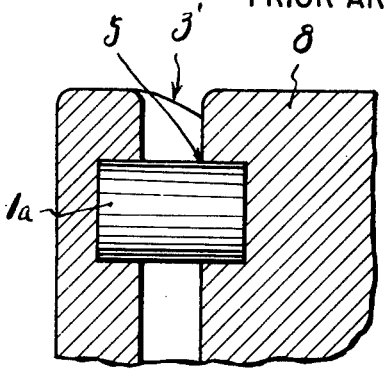
Fig. 4 PRIOR ART
FIG. 4 is a partial sectional view of one form of a previously known drum illustrating a particular groove therein.
Figure 4A:
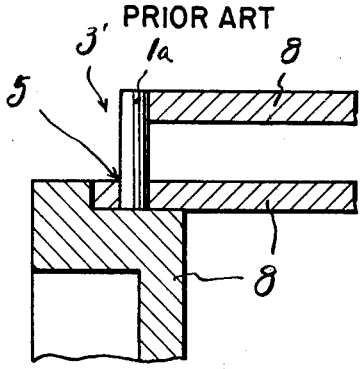
Fig. 4a PRIOR ART
FIG. 4*a* is a partial sectional view of one form of a previously known drum illustrating a particular groove therein.
Figure 4B:
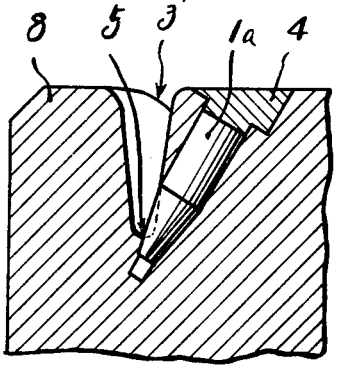
Fig. 4b PRIOR ART
FIG. 4*b* is a partial sectional view of one form of a previously known drum illustrating a particular groove therein.
Figure 4C:
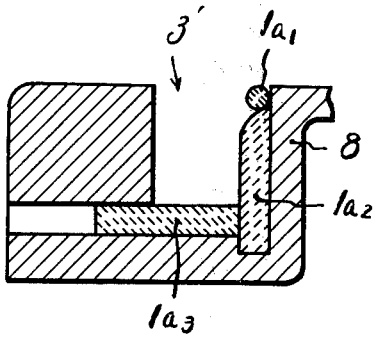
Fig. 4c PRIOR ART
FIG. 4*c* is a partial sectional view of one form of a previously known drum illustrating a particular groove therein.
Figure 4D:
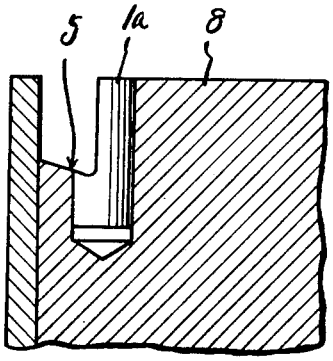
Fig. 4d PRIOR ART
FIG. 4*d* is a partial sectional view of one form of a previously known drum illustrating a particular groove therein.
Figure 5:
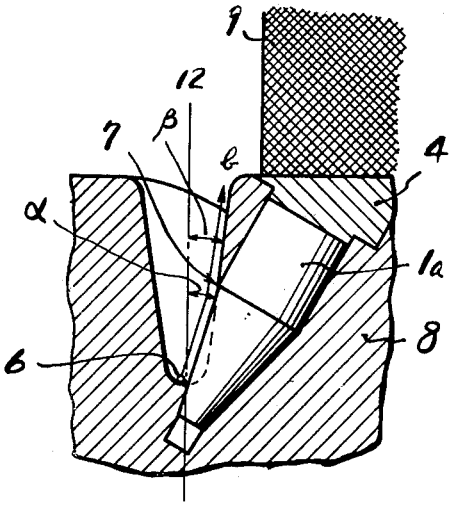
Fig. 5 PRIOR ART
FIG. 5 is an enlarged partial sectional view of the drum shown in FIG. 4*b* in operation.

A wear-resistant member 1 is formed with a recess having an arcuate bottom, as shown in FIG. 2, said member 1 being inserted into the lower portion of each of the turns 3′ in a yarn guide groove 3 at opposite traverse ends of a drum *a* and fixed in position by an adhesive filler 4, as shown in FIGS. 1 and 3.

Thus, as shown in FIG. 3, the recesses 2 of the wear-resistant members 1 form the bottoms of the yarn guide groove turns 3′ at opposite traverse ends, thereby providing a single integral yarn guide groove wherein opposite lateral surfaces or side walls of the recess 2 are flush with opposite lateral surfaces or side walls of the groove in each turn at either traverse end of the yarn guide groove formed in the relatively soft material suitable for the drum *a*.

Therefore, the yarn traveling around the turn 3′ will travel in contact with a portion of the recess 2 of the wear-resistant member 1.

Further, the lateral surface 10 with which the traveling yarn is contacted is finished so as to have an angle $\theta$ which assures that the end surfaces of the yarn package will be produced most neatly. Since the lateral surface 10 is straight, boundary 7 between the relatively soft material suitable for the drum *a* and the wear-resistant member 1 will not be subjected to any abnormal pressure from the yarn and hence will not develop wear.

Further, since the wear-resistant member 1 is inserted from the lateral surface of the drum parallelly to the central axis of the drum and fixed in position, it will never be thrown out under the centrifugal force during the rotation of the drum. Moreover, the fixing can be easily effected by the adhesive filler 4.

As has so far been described, according to the present invention, in a grooved traverse drum having a yarn guide spiral groove in the peripheral surface of a cylindrical body, a wear-resistant member having a recess in a portion thereof is inserted into each turn at either traverse end of the yarn guide groove and fixed in position. Therefore, the area with which the yarn is contacted is the recess in the highly wear-resistant member, so that even in the case of a highly wear-resistant yarn such as polyester type synthetic fiber yarn, there is no danger of the inner surface of the groove being subject to wear and the yarn is always smoothly guided and travels, there being no possibility of deterioration in quality or other drawbacks being caused. Further, there is no danger of the filler or wear-resistant members being thrown out during the rotation of the drum.

As for the material of the wear-resistant member 1, it may be any provided that its wear-resistance is higher than that of the material of the drum *a*; for example, it may be aluminum oxide or titanium oxide.

As for the shape of the groove bottom of the recess in the wear-resistant members 1, it may be arcuate, V-shape or U-shape.

Further, the wear-resistant members 1 are not limited in shape to a cylinder. For example, they may be conical or pyramidal.

The holes to be drilled in the drum *a* may be parallel to or at an angle with the center axis of the drum.

Further, the material of the drum may be plastics, aluminum, cast iron or steel.

What is claimed is:

1. In a grooved traverse drum construction having a cylindrical drum body and a spiral yarn guide groove formed in the peripheral surface of the cylindrical drum body, said yarn guide groove having a traverse end at each end of the drum body, with each traverse end having opposed spaced lateral side walls therein, the improvement of an aperture extending into each end of the drum body and intersecting the bottom of the opposed lateral side walls of each traverse end of the yarn guide groove, a wear-resistant element positioned in each axially extending aperture and extending inwardly beyong the traverse end of the yarn guiding groove, each of said wear-resistant elements comprising a body portion and a recess having opposite spaced side walls centrally positioned in said body portion, with the opposite spaced side walls of the recess portion being flush with the opposed spaced lateral side walls of each traverse end of the yarn guide groove and constituting a lower extension thereof whereby said recess portion constitutes the bottom of each of the traverse ends of the yarn guide groove.

2. In a grooved traverse drum construction as called for in claim 1, whereby the opposed lateral side walls of each of the traverse ends of the yarn guide groove and the opposed lateral side walls of the recess portion are straight.

3. In a grooved traverse drum construction in accordance with claim 1, wherein the aperture extending into each end of the drum body extends parallel to the axis of the drum body.

* * * * *